United States Patent [19]

Hasegawa et al.

[11] 4,394,986

[45] Jul. 26, 1983

[54] YARN WINDING APPARATUS

[75] Inventors: Katsumi Hasegawa, Kusatsu; Takahiro Kawabata; Shintaro Kuge, both of Otsu, all of Japan

[73] Assignee: Toray Industries, Inc., Japan

[21] Appl. No.: 263,350

[22] Filed: May 13, 1981

[51] Int. Cl.[3] ..... B65H 54/08; B65H 59/38

[52] U.S. Cl. ..... 242/18 R; 242/18.1; 242/26; 242/43 R; 242/45

[58] Field of Search ..... 242/18 R, 18 DD, 26, 242/43 R, 45, 18.1, 35.5 R

[56] References Cited

U.S. PATENT DOCUMENTS

| | | | |
|---|---|---|---|
| 3,615,060 | 10/1971 | Jenny | 242/26 X |
| 3,931,938 | 1/1976 | Hasegawa et al. | 242/45 |
| 3,937,409 | 2/1976 | Muller | 242/18 R |
| 4,049,211 | 9/1977 | Spescha | 242/18.1 X |
| 4,245,794 | 1/1981 | Hasegawa et al. | 242/45 |

FOREIGN PATENT DOCUMENTS

| | | | |
|---|---|---|---|
| 45-41060 | 12/1970 | Japan | 242/18.1 |
| 46-39134 | 11/1971 | Japan | 242/18.1 |
| 50-65628 | 6/1975 | Japan . | |

*Primary Examiner*—Stanley N. Gilreath
*Attorney, Agent, or Firm*—Austin R. Miller

[57] ABSTRACT

The present invention relates to a yarn winding apparatus wherein a yarn is wound on a bobbin tube at a constant wind ratio. According to the present invention, the rotational speed of a winding spindle is electrically controlled in accordance with yarn tension and the rotational speed of a traverse element driving shaft is electrically controlled relative to the rotational speed of the winding spindle in such a manner that the wind ratio is kept constant.

7 Claims, 21 Drawing Figures

YARN WINDING APPARATUS

BACKGROUND OF THE INVENTION

The present invention relates to a yarn winding apparatus, and more specifically, it relates to a yarn winding apparatus wherein a yarn is wound on a bobbin tube at a constant wind ratio.

Winding a yarn at a constant wind ratio has a remarkable feature in that such winding can easily prevent ribbon-winding from occuring. Therefore, a yarn package wound at a constant wind ratio can be very smoothly unwound at high speed. Such a yarn package is particularly required with the development of water or air jet looms in which looms a weft yarn is unwound from a supply yarn package at high speed, such as at about 1,200 m/min.

In a conventional yarn winding apparatus which winds a yarn at a constant wind ratio, a winding spindle for mounting a bobbin is driven by a motor. The driving power for a traverse means is transmitted from the winding spindle by means of a timing-belt or gears, whereby the wind ratio is kept constant. However such a conventional yarn winding apparatus with a constant wind ratio has several problems as described below.

According to the conventional winding apparatus, it is difficult to wind a yarn at high speed, e.g. at several thousand meters per minute, because of the mechanical transmission of the driving power from the winding spindle to the traverse means. If the winding is carried out at high speed, problems in lubrication of the gear device arise and slippage between the belt and the pulley which is caused by the difference in rotational speeds of the winding spindle and the traverse means occurs. In addition, the noise level is greatly increased at high speeds.

Another problem of the conventional winding apparatus is the difficulty in changing the wind ratio. The wind ratio should be changed in accordance with various conditions such as the type of yarn material, the denier of the yarn, the quality of the yarn, the size of the yarn package to be formed and the like. However, according to the mechanical transmission in a conventinal apparatus, changing the wind ratio is very troublesome.

Further problems with the conventional winding apparatus are encountered in the space necessary for the winding apparatus and the cost of the installation. In a conventional winding apparatus having a plurality of winding units, each winding unit comprises, as a unit, a yarn tension sensor, a speed changing means for controlling a motor of a winding spindle based on a signal issued from the yarn tension sensor, and a gear device for transmitting the driving power from the winding spindle to a traverse means. As a result, a conventional winding apparatus requires considerable space and high installation cost.

BRIEF SUMMARY OF THE INVENTION

An object of the present invention is to provide a yarn winding apparatus which eliminates the problems of the conventional techniques and permits controlling the wind ratio electrically at a predetermned value from the beginning of the winding to the completion of the winding.

Another object of the present invention is to provide a yarn winding apparatus which permits changing the wind ratio to several predetermined values, step by step, during the winding.

A further object of the present invention is to provide a revolving type winder having two winding spindles and one traverse means, which permits winding a yarn at a constant wind ratio.

A still further object of the present invention is to provide a yarn winding apparatus having a plurality of winding devices, each of which devices comprises a winding spindle and a traverse means, wherein all winding devices are electrically and simultaneously controlled so as to keep a constant wind ratio.

To achieve the above-mentioned object, the appartus of the present invention has following construction.

A yarn winding apparatus which comprises:

(a) a winding device for winding a yarn to form a yarn package; which includes a winding spindle for mounting a bobbin tube, a traverse element for imparting a traverse motion to the yarn, and a traverse element driving shaft for driving said traverse element;

(b) a first motor for driving said winding spindle;

(c) a second motor for driving said traverse element driving shaft;

(d) means for controlling said first motor for the winding spindle so as to keep the yarn winding speed substantially constant from the beginning of the winding to the completion of the winding;

(e) means for detecting the speed of rotation of said winding spindle and for generating a first electrical signal corresponding to the detected rotational speed;

(f) means for detecting the speed of rotation of said traverse element driving shaft and for generating a second electrical signal corresponding to the detected rotational speed;

(g) means for controlling the second motor for the traverse element driving shaft so as to substantially keep the ratio of the rotational speed of the winding spindle to the rotational speed of the traverse element driving shaft at a predetermined value or values from the beginning of the winding to the completion of the winding in accordance with said first electrical signal and said second electrical signal.

Other features and advantages of the present invention will be apparent from the following description given in connection with the accompanying drawings.

DETAILED DESCRIPTION OF PREFERRED EMBODIMENTS

Details of the embodiments of the present invention will be described with reference to the drawings. It is to be understood, however, that the present invention is not confined to these embodiments.

Figure 1:
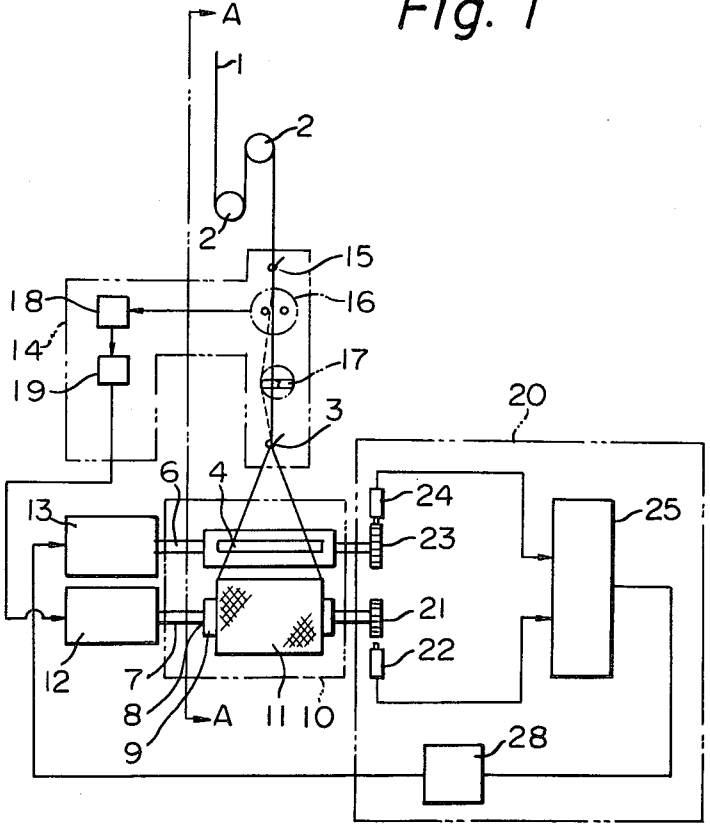
FIG. 1 is a schematic front view showing one embodiment of a yarn winding apparatus of the present invention.
Figure 2:
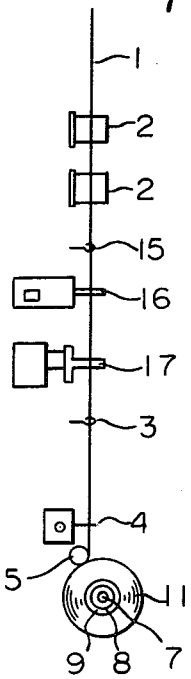
FIG. 2 is a schematic side view of the yarn winding apparatus shown in FIG. 1, taken on a line A—A.

As shown in FIGS. 1 and 2, a yarn 1 is supplied at a constant speed by means of feed rollers 2 such as godet rollers. Yarn 1 is, for example, a yarn which is spun from a spinnerette and then is drawn at a given draw ratio after oil treatment. The supplied yarn 1 is passed through a fixed guide 3 acting as the fulcrum or pivot point of the traverse motion of yarn 1. Yarn 1, passed through fixed guide 3, is wound into a package 11 by a winding device 10. Winding device 10 comprises traverse means and winding spindle 7 for mounting bobbin tube 9. The traverse means includes traverse element 4 for imparting a traverse motion to yarn 1, touch roller 5 for contacting with surface of the yarn package 11, and shaft 6 for driving traverse element 4. The winding spindle has a bobbin supporter 8 which supports bobbin tube 9.

Winding spindle 7 is connected to a first motor 12 and is rotated by the rotation of the output shaft of motor 12. The traverse element driving shaft is connected with a second motor 13 and is rotated by the rotation of the output shaft of second motor 13. When the traverse element driving shaft 6 is driven by second motor 13, the traverse motion is imparted to the yarn to be wound.

The above-mentioned winding device and the driving motors are well-known in conventional winding apparatuses.

In order to keep a substantially constant winding speed from the beginning of the winding to the completion of the winding, it is necessary to control the rotational speed of the winding spindle in such a manner that the rotational speed of the spindle is gradually decreased in accordance with the increase in the diameter of the yarn package. For this purpose, means 14 for controlling motor 12 for winding spindle 7 is arranged upstream of winding device 10. FIG. 1 shows one of the embodiments of such controlling means. The controlling means in FIG. 1 comprises yarn guide 15 arranged upstream of the fixed guide 3, yarn tension sensing means 16, disposed between said two guides 3 and 15, for generating an electrical signal indicative of the tension in the yarn, and rotary guide 17 which is rotated and pediodically deflects yarn 1 slightly from its straight yarn passage between yarn guides 3 and 15. The controlling means further comprises a means 18 for comparing an electrical signal from yarn tension sensing means 16 with a predetermined electrical signal and for generating an error compensation signal in accordance with the difference between both said signals and speed changing means 19 for controlling the rotational speed of first motor 12 which drives the winding spindle in accordance with said error compensation signal. The above-mentioned controlling means 14 is disclosed in detail in UK Patent Publication No. 2,015,589 A.

Another type of controlling means is disclosed in U.S. Pat. No. 3,931,938. According to the apparatus of U.S. Pat. No. 3,931,938, a yarn tension sensing means is disposed downstream of and near the fixed guide to act as the fulcrum of the traverse motion. Means for comparing a detected signal from the sensing means with a predetermined signal and means for controlling a first motor are respectively similar to these explained before in connection with the embodiment of FIG. 1.

Further, means for controlling the rotational speed of a motor for a winding spindle are also disclosed in Japanese Laid-opened Patent Publications 93137/79, 93142/79, 112235/79 and 2577/80.

Now, means 20 for controlling the wind ratio at a constant value or at predetermined values will be explained.

Winding spindle 7 is provided with rotary disc 21 at one end of spindle 7. Rotary disc 21 rotates together with spindle 7. Pulse pickup 22 is disposed at a position in which the pulse pickup 22 faces rotary disc 21. When winding spindle 7 rotates for one revolution, a certain number (Zsp) of pulses are produced by the pulse pickup.

In one embodiment, rotary disc 21 is a disc having a desired number of notches or projections. Pulse pickup 22 is a magnetic pickup transducer which contains an electrical coil having an alternating voltage generated across its terminals as a result of changes in magnetic flux in the magnetic circuit which is formed by disc 21 and magnetic pickup 22. These flux changes are produced by the rotation of notched disc 21.

According to another embodiment, there is provided a light source near rotary disc 21 which has holes or notches or projections. Pulse pickup 22 is an element for detecting optical changes and generating a signal, similar to a photoconductive cell.

Traverse element driving shaft 6 is also provided with a rotary disc 23 at one end of the shaft. Rotary disc 23 rotates together with driving shaft 6. Pulse pickup 24 is disposed against rotary disc 23. When traverse element driving shaft 6 rotates one turn, another given number ($Z_{TR}$) of pulses are produced from pulse pickup 24. According to one embodiment, rotary disc 23 is a disc having a desired number of notches and pulse pickup 24 is a magnetic pickup transducer similar to magnetic pickup transducer 22.

Numbers $Z_{SP}$ and $Z_{TR}$ are determined as follows.

The wind ratio is the number of yarn wraps on the winding package during one complete cycle of the traverse. That is, when the winding spindle 7 rotates $R_{SP}$ number of revolutions during one complete cycle of the traverse ($R_{SP}$ can be any number or mixed number) and the driving shaft 6 rotates $R_{TR}$ number of revolutions during one complete cycle of the traverse, ($R_{TR}$ can be any number or mixed number) the wind ratio is a value of $R_{SP}/R_{TR}$. The numbers $Z_{SP}$ and $Z_{TR}$ are determined so as to equalize the value of $R_{SP} \times Z_{SP}$ to the value of $R_{TR} \times Z_{TR}$. Therefore, discs 21 and 23 are designed so as to obtain the required numbers of pulses $Z_{SP}$ and $Z_{TR}$ per one revolution.

Consequently, if the winding spindle 7 and the traverse element driving shaft are respectively rotated at constant rotational speeds with a desired wind ratio, the number of the produced pulses of pulse pickup 22 per unit of time is equal to the number of the produced pulses of pulse pickup 24 per unit of time.

However, the rotational speed of the winding spindle 7 is changed during winding in order to keep a constant winding speed. As a result, the rotational speed of traverse element driving shaft 6 is changed in accordance with the change of the rotational speed of the winding speed in order to keep the desired constant wind ratio.

According to the present invention there is provided means for controlling second motor 13 which drives traverse element driving shaft 6. In the embodiment of FIG. 1, the controlling means for the second motor comprises means 25 for comparing a first electrical signal from pulse pickup 22 with a second electrical signal from pulse pickup 24. Comparing means 25 generates a third electrical signal corresponding to the difference between the first and second electrical signals. The controlling means for the second motor further comprises speed changing means 28. Speed changing means 28 is actuated by the third electrical signal from comparing means 25 and controls the rotational speed of second motor 13 in such a manner that the second electrical signal is not generated from comparing means 25, i.e. that the number of pulses from the pickup 24 becomes equal to the number of pulses from the pickup 22.

Figure 3:
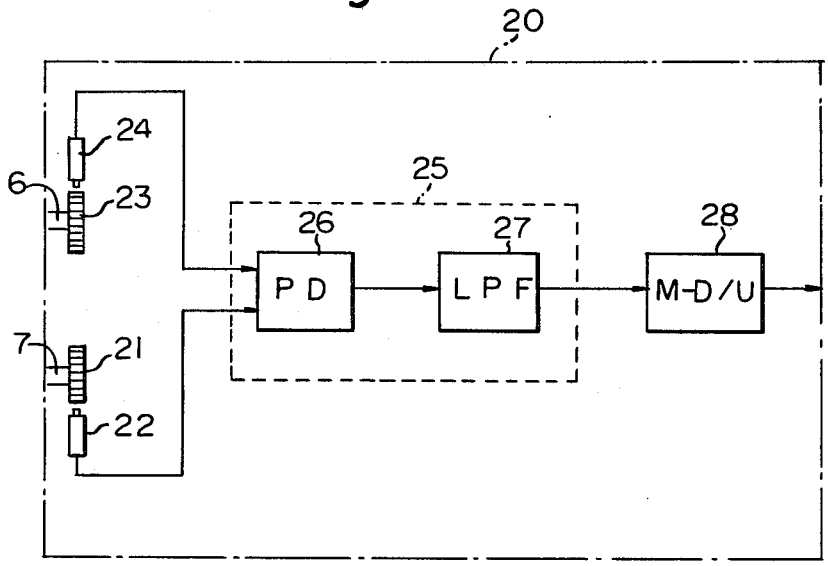
FIG. 3 is a block diagram of a wind ratio controlling means illustrated in FIG. 1.
Figure 4:
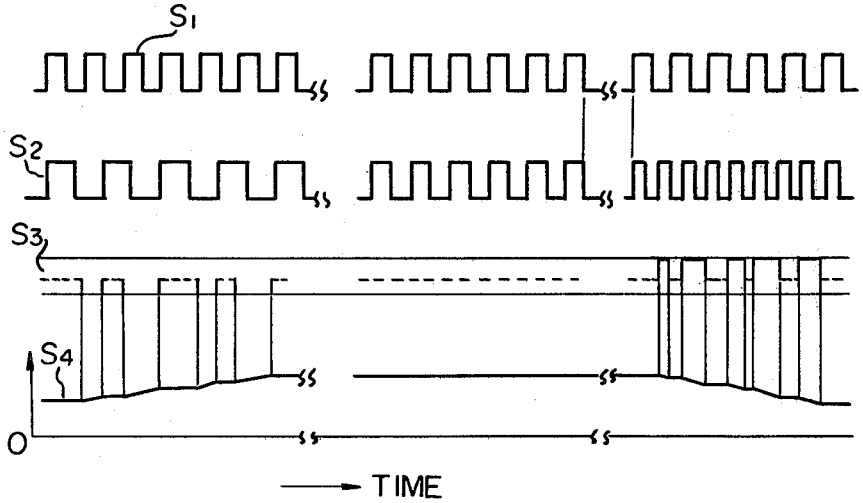
FIG. 4 is a time chart of signals in a means for comparing signal generated by the rotation of a winding spindle.

According to an embodiment illustrated in FIG. 3, comparing means 25 comprises phase comparator 26 and low-pass filter 27. Phase comparator 26 detects the phase difference between two pulse signals $S_1$ and $S_2$ as illustrated in FIG. 4, from the pulse pickups 22 and 24, and generates pulse signal $S_3$ as illustrated in FIG. 4, which signal $S_3$ indicates the comparison result. The pulse signal $S_3$ has a pulse duration corresponding to the phase differences between the signal $S_1$ and $S_2$, and has negative and positive polarities with respect to a reference level. When the frequency $f_1$ of signal $S_1$ is higher than the frequency $f_2$ of signal $S_2$, signal $S_3$ has a negative polarity. When the frequency $f_1$ of signal $S_1$ is lower than the frequency $f_2$ of signal $S_2$, signal $S_3$ has a positive polarity (see FIG. 4).

Low-pass filter 27 integrates the output signal $S_3$ from the phase comparator with respect to time and generates a D.C. signal $S_4$ as illustrated in FIG. 4. The output signal $S_4$ from low-pass filter 26 is applied to speed changing means 28.

If the second motor 13 is an induction motor, speed changing means 28 is an invertor which controls the frequency of the drive current of the induction motor 13 in accordance with input signal $S_4$.

If the second motor 13 is a D.C. motor, speed changing means 28 is a D.C. motor controller which controls the field current of the D.C. motor in accordance with the input signal $S_4$.

Figure 5:
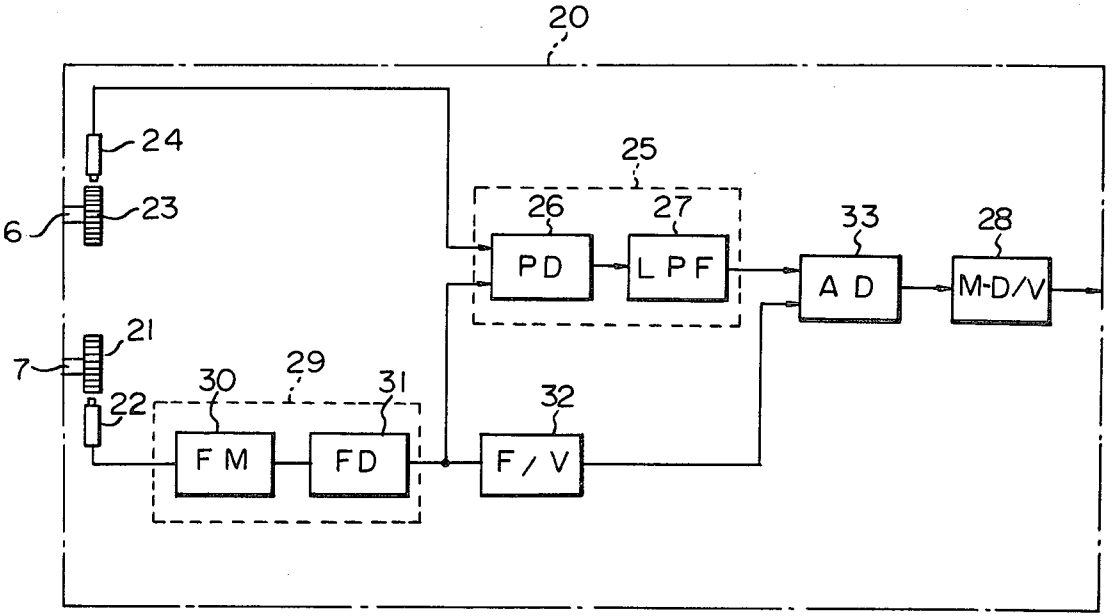
FIG. 5 is a block diagram of another embodiment of the wind ratio controlling means.

FIG. 5 shows another embodiment of means 20 for controlling the wind ratio at a constant value.

The components in FIG. 5 respectively correspond to the components in FIG. 1 designated by the same reference numerals.

According to the embodiment of FIG. 5, controlling means 20 further comprises frequency multiplying and dividing unit 29, frequency/voltage converter 32 and adder 33. Multiplying and dividing unit 29 comprises frequency multiplier 30 which multiplies the number of pulse signals from pulse pickup 22 by the desired number of times, for example, the numerical value of M, and frequency divider 31 which divides the multiplied number of the pulse by the desired value, for example, the numerical value of N. The output signal of the multiplying and dividing unit 29 is applied to the comparing means 25 and to the frequency/voltage (F/V) converter 32. The output signals from comparing means 25 and from F/V converter are respectively applied to adder 33. In adder 33, the input signals are combined to give an output signal amplitude that is proportional to the sum of the input signal amplitudes. The output signal from adder 33 is applied to speed changing means 28.

The number of output pulses from multiplying and dividing unit 29 during one complete cycle of the traverse is $R_{SP} \times Z_{SP} \times (M/N)$, whereas the number of output pulses from pickup 24 during one complete cycle of the traverse is $R_{TR} \times Z_{TR}$. In this embodiment, the values of M and N are determined in such a way that the value of $R_{SP} \times Z_{SP} \times (M/N)$ is equal to the value of $R_{TR} \times Z_{TR}$. The value of M/N can be easily set and changed electrically. Therefore, according to the embodiment of FIG. 5, it is not necessary to limit the structure of rotary discs 21 and 23 in view of the values $Z_{SP}$ and $Z_{TR}$. The values $Z_{SP}$ and $Z_{TR}$ can be selected appropriately.

Figure 6:
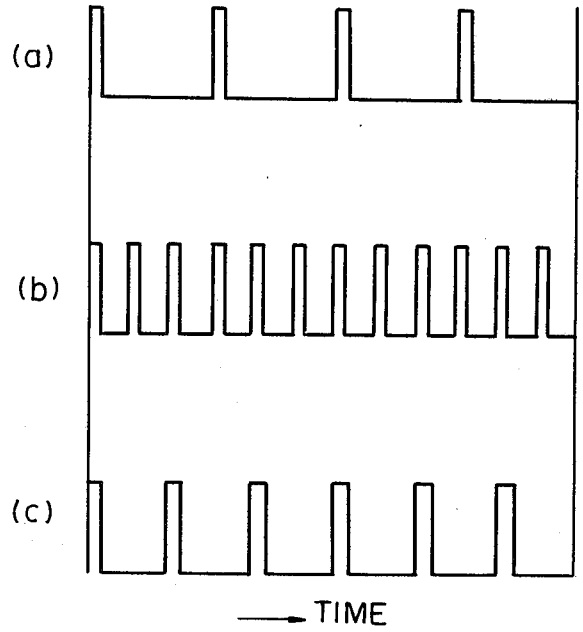
FIG. 6 is a time chart of signals in a multiplying and dividing unit.

FIG. 6 is a diagram showing the relationship between the input and output signals in multiplying and dividing unit 29. FIG. 6 (*a*) shows the input pulse signals ($P\ H_Z$) from pickup 22. FIG. 6 (*b*) shows pulse signals multiplied by three times ($3PH_Z$). FIG. 6 (*c*) shows the output pulse signals divided into half ($3/2\ P\ H_Z$).

Figure 7:
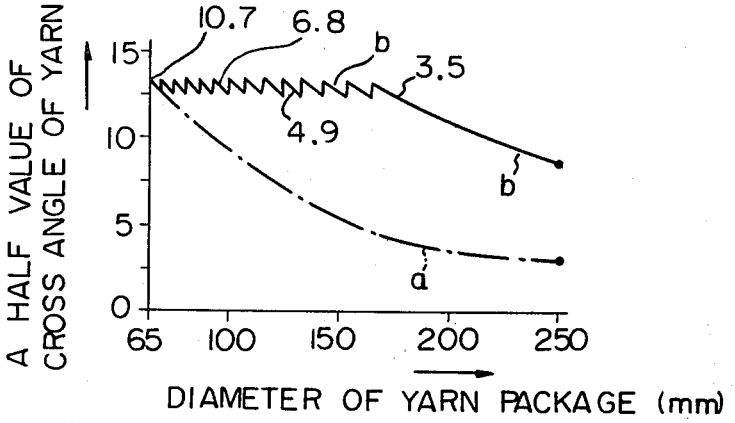
FIG. 7 is a graph showing the relationship between a half value of the cross angle of a yarn on a yarn package and the diameter of the yarn package.

The wind ratio can be easily changed by changing the multiplying value M and the dividing value N. FIG. 7 is a graph showing the relationship between a half value of the cross angle of yarn on yarn package 11 and the diameter of the yarn package. A dot and dash curved line (a) shows the change of the half value of the cross angle when the wind ratio is kept at a constant value from the beginning of the winding to the completion of the winding. In this case the cross angle gradually decreases as the diameter of the yarn package increases. A solid saw-toothed line 32 shows the change of the cross angle when the wind ratio is changed step by step to predetermined values during the winding. Each of the wind ratios is kept substantially constant for a certain time duration. According to the solid line (b), setting of the wind ratio takes place fourteen times from a value of about 10.7 to a value of about 3.5.

In the case of a yarn of normal filaments having a relatively low elasticity, such as untextured filament yarn, it is possible to wind the yarn at a predetermined constant wind ratio from the beginning to the completion of the winding if the wind ratio is appropriately selected. The yarn package produced has good package shape and the yarn can be smoothly unwound from the package. The selection of an appropriate wind ratio is based on experiments which were carried out with wind ratios having several different values.

On the other hand, in the case of a yarn of filaments having a relatively high elastivity, such as a textured yarn, if the cross angle of the yarn on a yarn package is reduced to a smaller angle than an angle of a certain degree during the winding, the yarn package produced has poor package shape. For example, both side faces of the yarn package will have bulges. Further, the yarn can not be smoothly unwound from such a yarn package and breakage of the yarn may occur.

Therefore, in order to wind a yarn having relatively high elasticity, it is necessary to keep the cross angle of the yarn on the yarn package at least larger than the critical angle. For this purpose, the wind ratio is changed several times during the winding. Preferably, as shown in FIG. 7, the changing of the wind ratio is carried out until the diameter of the yarn package reaches a certain size from the beginning of the winding, because the portion of the package having a small diameter in the yarn package produced is liable to get out of shape and as a result the yarn will not be smoothly unwound from such portion. Preferably, when changing the wind ratio, the difference between the preceding value of the wind ratio and the new value of the wind ratio should be small, with changes in the yarn tension small. Each wind ratio should be kept for a certain duration.

As an example, the conditions are described hereinbelow for winding a false-twisted textured yarn of 150 denier, 48 filament of polyethylene terephthalate, on a bobbin tube having a diameter of 65 mm, to form a yarn package with a 10 inch width with an angle formed by a side surface of the package and by the longitudinal axis of the package of 13 degrees.

A helical angle of the yarn on a yarn package at the beginning of the winding, which helical angle corresponds to half of the cross angle of the yarn, was selected at an angle of 13 degrees. The wind ratio was a value of about 10.2.

In the case where the winding was carried out with the constant wind ratio of 10.2, both side surfaces of the yarn package bulged when the diameter of the package reached a range of between 100 mm and 160 mm. The yarn package produced had poor package shape and the yarn could not be unwound smoothly at high speed.

On the other hand, in the case where the wind ratio was changed step by step until the diameter of the yarn package reached about 160, the helical angle of the yarn on the package corresponding to a half value of the cross angle was kept within a range of between about 13.5 degrees and about 12.5 degrees. To achieve this, values of the wind ratio were changed step by step thirteen times as the helical angle decreased.

Table 1 shows the relationship in an embodiment among values of the wind ratio (A), the diameter of a yarn package (D mm), number (No) of steps for changing the wind ratio (A), thickness (t mm) of the wound layer in the package, the multiplying value of M, and the dividing value of N. The wind ratio was changed 30 times.

TABLE

| No | t mm | D mm | Wind Ratio A | M | N |
|---|---|---|---|---|---|
| 1 | 1 | 65 | 10.1557 | 994 | 970 |
| 2 | 1.15 | 67 | 9.7705 | 977 | 991 |
| 3 | 1.30 | 69.3 | 9.4188 | 862 | 907 |
| 4 | 1.45 | 71.9 | 9.1557 | 837 | 906 |
| 5 | 1.60 | 74.8 | 8.6135 | 814 | 937 |
| 6 | 1.75 | 78 | 8.2295 | 749 | 902 |
| 7 | 1.9 | 81.5 | 7.7705 | 748 | 954 |
| 8 | 2.05 | 85.3 | 7.3863 | 714 | 958 |
| 9 | 2.2 | 89.4 | 7.1522 | 669 | 927 |
| 10 | 2.35 | 93.8 | 6.6140 | 634 | 950 |
| 11 | 2.5 | 98.5 | 6.3067 | 574 | 902 |
| 12 | 2.65 | 103.5 | 5.8474 | 544 | 922 |
| 13 | 2.8 | 108.8 | 5.5820 | 521 | 925 |
| 14 | 2.95 | 114.4 | 5.3088 | 533 | 995 |
| 15 | 3.1 | 120.3 | 5.1527 | 509 | 979 |
| 16 | 3.25 | 126.5 | 4.6934 | 466 | 984 |
| 17 | 3.4 | 133 | 4.4156 | 405 | 909 |
| 18 | 3.55 | 139.8 | 4.2298 | 414 | 970 |
| 19 | 3.7 | 146.9 | 4.1530 | 396 | 945 |
| 20 | 3.85 | 154.3 | 3.7683 | 354 | 931 |
| 21 | 4 | 162 | 3.5842 | 332 | 918 |
| 22 | 4.15 | 170 | 3.3854 | 317 | 928 |
| 23 | 4.3 | 178.3 | 3.2136 | 298 | 919 |
| 24 | 4.45 | 186.9 | 3.1547 | 318 | 999 |
| 25 | 4.6 | 195.8 | 2.8469 | 266 | 926 |
| 26 | 4.75 | 205 | 2.7850 | 265 | 943 |
| 27 | 4.9 | 214.5 | 2.5825 | 240 | 921 |
| 28 | 5.05 | 224.3 | 2.4159 | 225 | 923 |
| 29 | 5.2 | 234.4 | 2.3853 | 239 | 993 |
| 30 | 5.35 | 244.8 | 2.2301 | 223 | 991 |

Now, according to FIGS. 8 and 9, control of the wind ratio which is changed several times during winding as shown by line (b) in FIG. 7 will be explained.

Figure 8:
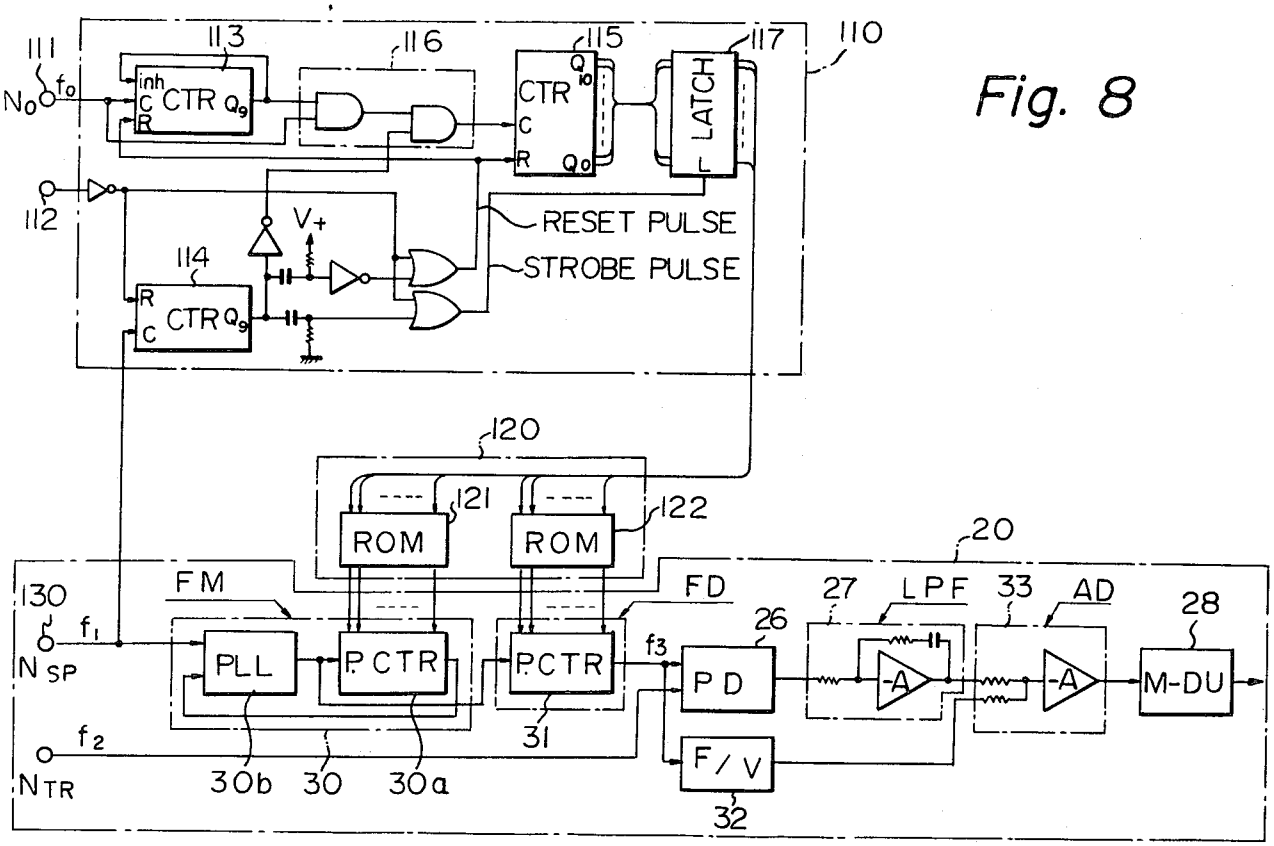
FIG. 8 is a block diagram illustrating a further embodiment of the wind ratio controlling means.

In FIG. 8 wind ratio controlling means 20 is substantially similar to that illustrated in FIG. 5, except for the following points. That is, multiplying and dividing factors of the frequency multiplier 30 and the frequency divider 31 are programmable in this embodiment of FIGS. 8 and 9. Therefore, each circuit element will not again be described in detail here.

Figure 9:
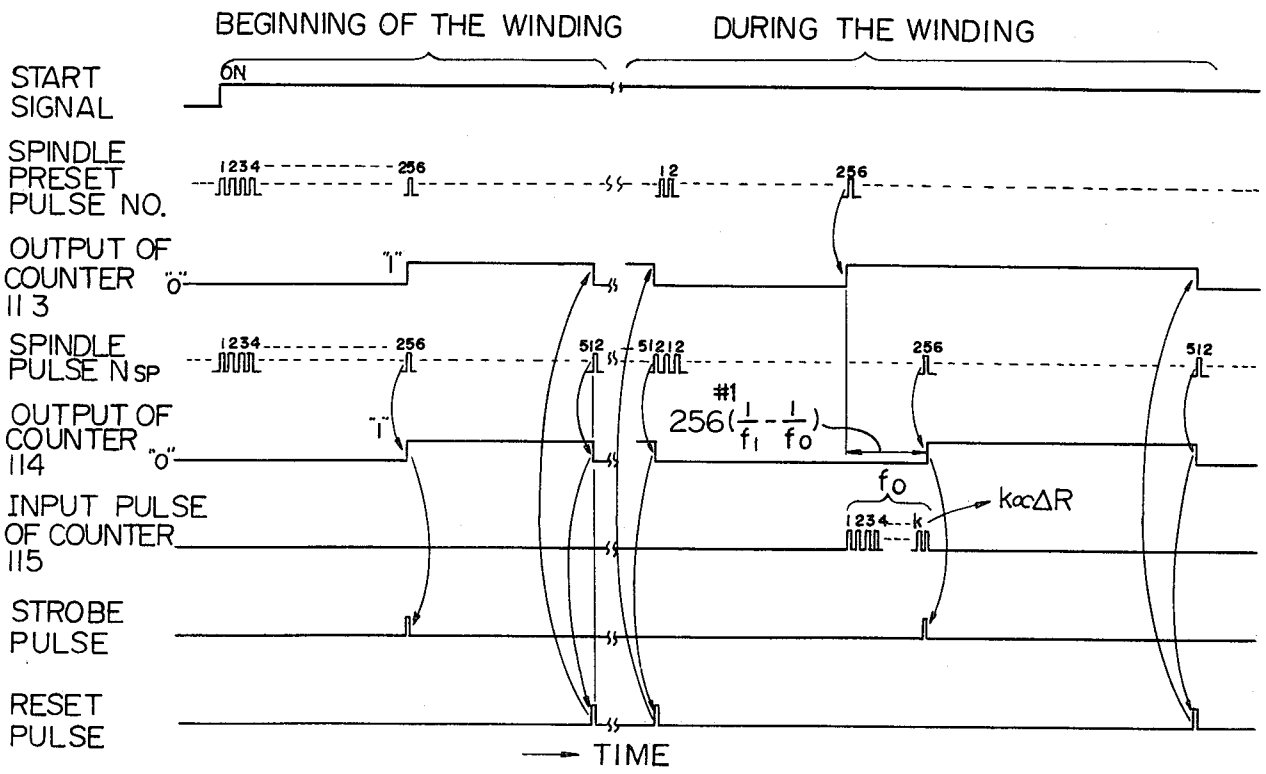
FIG. 9 is a time chart of signals in the wind ratio controlling means illustrated in FIG. 8.

According to the embodiment of FIGS. 8 and 9, are there are provided means 110 for detecting the diameter of the yarn package and storage means 120 for storing various wind ratio data.

Package diameter detecting means 110 receives via input terminal 111 a spindle preset pulse $N_0$ having a predetermined constant frequency $f_0$, which spindle preset pulse is generally used for pre-setting the rotational speed of the winding spindle before the yarn is threaded on the winding device. Package diameter detecting means 110 also receives, via input terminal 130, a spindle pulse $N_{sp}$ having a frequency $f_1$, which spindle pulse $N_{sp}$ is generated during the wnding by pulse pickup 22, corresponding to the rotational speed of winding spindle 7. Further, package diameter detecting means 110 receives a start signal via input terminal 112. This start signal is generated when the yarn is threaded through yarn tension sensing means 16 to the winding spindle which has been rotated at a certain rotational speed in advance.

When package diameter detecting means 110 receives the start signal, binary counters 113, 114 and 115 are reset. Binary counter 113, having a capacity of nine bits, starts to count the spindle preset pulse $N_0$ applied thereto via the input terminal 111. When 256 spindle preset pulses are applied to counter 113, the output of counter 113 is changed from "0" to "1". Then counter 113 stops its counting operation until the next reset pulse is applied thereto. Binary counter 114, also having a capacity of nine bits, starts to count the spindle pulses $N_{sp}$ applied there to via input terminal 130. When 256 spindle pulses are applied to counter 114, the output of counter 114 is changed from "0" to "1". Gate circuit 116 allows spindle preset pulse $N_0$ to pass through gate circuit 116 only when the output level of counter 113 is "1" and the output level of counter 114 is "0". Counter 115 counts the number of pulses passing through gate circuit 116.

The contents in counter 115 are applied to latch circuit 117 and are temporarily stored therein when a strobe pulse is applied to the load terminal of latch circuit 117. The strobe pulse is produced each time the output level of the counter 114 is changed from "0" to "1". On the other hand, the contents in the counters 113 and 115 are cleared by a reset pulse which is generated each time the output level of the counter 114 is changed from "1" to "0".

Wind ratio storage means 120 comprises two read only memories (ROM) 121 and 122. Factor data in relation to multiplying factors M for the programmable frequency multiplier 30 are preliminarily stored in ROM 121, whereas factor data in relation to dividing factors N for programmable frequency divider 31 are preliminarily stored in the other ROM 122.

The stored contents of latch circuit 117 is fed to each ROM 121 and 122 as address information. Thus, the factor data in ROM 121 corresponding to the instructed address is fed to programmable frequency multiplier 30, and the factor data in ROM 122 corresponding to the instructed address is fed to programmable frequency divider 31.

Programmable frequency multiplier 30 is a well known frequency synthesizer which comprises programmable counter 30*a* and phase lock loop 30*b*, and which multiplies the frequency of input spindle pulse $N_{SP}$ from pulse pickup 22 by a factor M corresponding to the variable factor data fed from ROM 121.

Programmable frequency divider 31 is a well known programmable counter which divides the frequency of the input signal from multiplier 30 by a factor N corresponding to the variable factor data fed from ROM 122.

The operation of the package diameter detecting means will be explained with reference to FIG. 9.

Before a yarn is threaded through the yarn tension sensing means, the winding spindle is rotated at a predetermined rotational speed. The predetermined rotational speed of the winding spindle is determined by spindle preset pulse $N_0$ in such a way that the frequency $f_1$ of spindle pulse $N_{sp}$ is equal to the frequency $f_0$ of spindle preset pulse $N_0$.

Counter 113 counts the number of spindle preset pulses $N_0$, whereas counter 114 counts the number of spindle pulses $N_{sp}$. Counter 115 counts the number of spindle preset pulses $N_0$ from the time when the counter 113 counts 256 spindle preset pulses, to the time when the counter 114 counts 257 spindle pulses.

Therefore, at the beginning of the winding, counter 115 does not count any pulses because there is no difference between the frequencies $f_0$ and $f_1$.

Some time after the start of winding, the yarn is wound on the bobbin tube so that a yarn layer having a certain thickness is formed. Since the diameter of the package on the bobbin tube is gradually increased, the rotational speed of the winding spindle is gradually decreased in accordance with the instructions from the yarn tension sensing means. As a result the frequency $f_1$ of the spindle pulse $N_{sp}$ is decreased. In such a case counter 115 counts the number of the spindle preset pulses corresponding to the difference between the frequencies $f_0$ and $f_1$.

The contents in counter 115 to be applied to latch circuit 117 corresponds to the thickness of the yarn package. That is, the thickness of the yarn package corresponds to the number of spindle preset pulses $N_0$ which are counted by counter 115 from the time when counter 113 counts 256 spindle preset pulses $N_0$ to the time when counter 114 counts 256 spindle pulses $N_{sp}$. The reason the thickness of the yarn package corresponds to the number of spindle preset pulses $N_0$ counted by counter 115, is as follows.

v: yarn winding speed (constant)

$R_0$: the rotational speed of the winding spindle at the time of starting the winding $R_{sp}$: the rotational speed of the winding spindle during the winding $r_0$: radius of the empty bobbin tube $r_1$: radius of a yarn package during the winding $\Delta r$: thickness of a yarn package $v = 2\pi r_0 R_0 = 2\pi r R_{sp}$ $r_0 = v/2\pi R_0$, $r = v/2\pi R_{sp}$ $\Delta r =$ $$r - r_0 = \frac{v}{2\pi}\left(\frac{1}{R_{sp}} - \frac{1}{R_0}\right)$$

$R_{sp} \propto f_1$, $R_0 \propto f_0$ $\therefore \Delta r \propto$ $$\frac{1}{f_1} - \frac{1}{f_0}$$

The value of $$\left(\frac{1}{f_1} - \frac{1}{f_0}\right)$$

is correlative to the number of the spindle preset pulses counted by counter 115.

Figure 10:
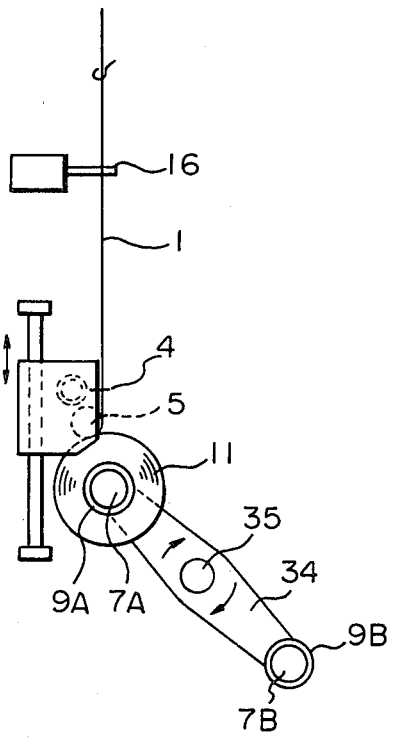
FIG. 10 is a schematic side view of an embodiment of a revolving type yarn winding apparatus of the present invention.
Figure 11:
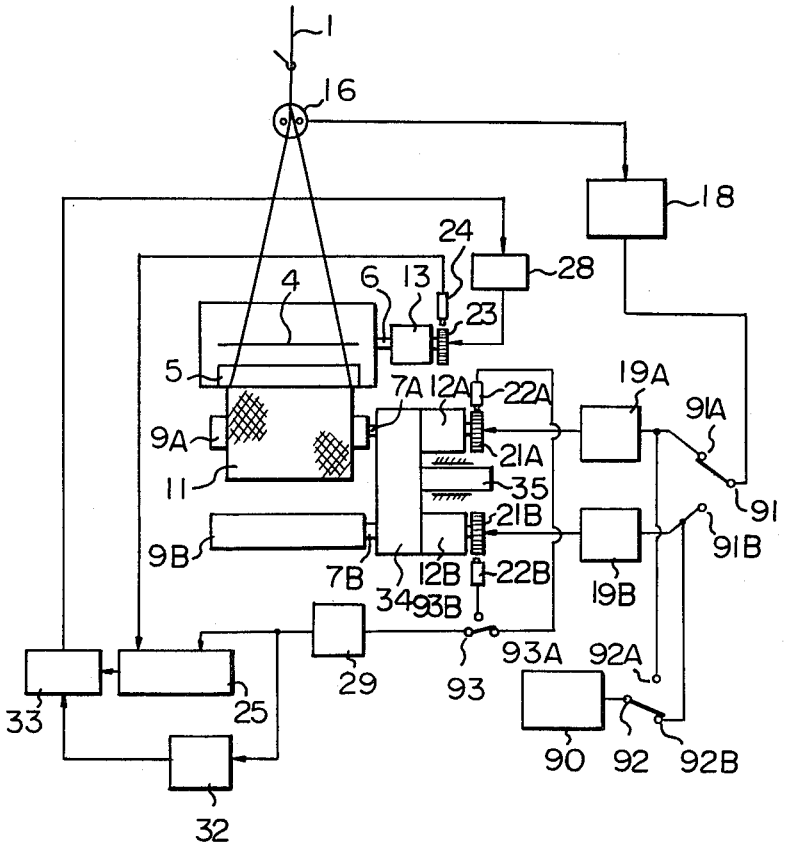
FIG. 11 is a schematic front view of a revolving type winder of the present invention.
Figure 12:
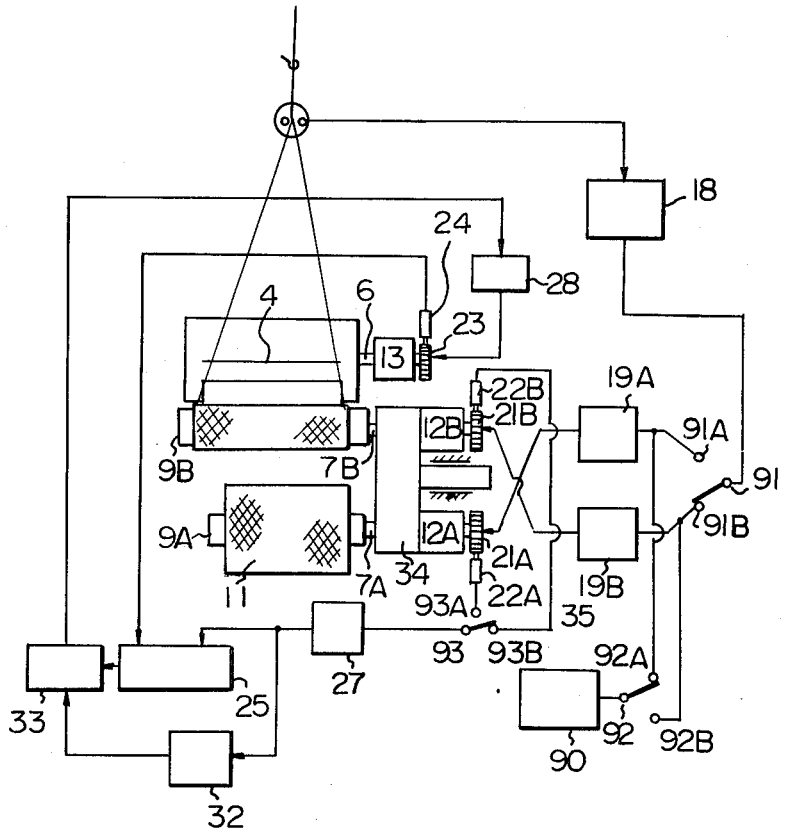
FIG. 12 is a schematic front view of the winder illustrated in FIG. 11, which shows a condition of the winder after a bobbin-change.

As illustrated in FIGS. 10 to 12, the present invention can be applied to a revolving-type winder.

Generally, in a conventional system for winding a yarn at a constant wind ratio, the traverse means is mechanically driven via a winding spindle. However, a revolving-type winder has two or more winding spindles and one traverse means, and it is very difficult to transmit the driving power from the winding spindle to the traverse means because after each completion of forming a yarn package, the winding spindle which has been faced to the trasverse means is exchanged for another winding spindle reversing their positions. Consequently, according to a conventional revolving-type winder, winding a yarn at a constant wind ratio cannot be carried out.

On the contrary, according to the present invention, rotational speeds of the winding spindle and traverse means are controlled electrically and therefore a winding system with a constant wind ratio can be applied to a revolving-type winder.

FIG. 10 is a schematic side elevation view of a revolving-type winder. FIG. 11 is a schematic front view showing an embodiment of a revolving-type winder of the present invention. FIG. 12 is a schematic front view showing the same embodiment illustrated in FIG. 11, but showing the state thereof after exchanging bobbins.

In FIGS. 10 and 11, a revolving arm 34 can be rotated about an axis 35. The revolving arm 34 supports winding spindles 7A and 7B, one at each end of arm 34. spindles 7A and 7B are directly connected with first electrical motors 12A and 12B respectively. In normal operation, yarn 1 is wound on a bobbin tube mounted on one of said two winding spindles 7A and 7B after passing through yarn tension sensing mean 16 and traverse element 4.

Two rotary discs 21A and 21B are respectively attached to winding spindles 7A and 7B. Two pulse pickups 22A and 22B are respectively disposed against the corresponding rotary discs 21A and 21B having notches or projections and supported by revolving arm 34. When winding spindles 7A and 7B rotate, pulse pickups 22A and 22B generate electrical signals corresponding to the rotational speeds of the winding spindles.

Traverse element driving shaft 6 is also directly connected with a second electrical motor 13 and moves traverse element 4 for imparting the traverse motion to the yarn 1 to be wound. Traverse element driving shaft 6 is provided with rotary disc 23 having notches or projections, and pulse pickup 24 is disposed against rotary disc 23 in order to generate an electrical signal corresponding to the rotational speed of traverse element driving shaft 6.

In the embodiment illustrated in FIGS. 10 to 12, members designated by the same or similar reference numerals as appearing in the embodiments illustrated in FIGS. 1 to 5, respectively correspond to the members of the embodiment in FIGS. 1 to 5. Therefore such members will not be explained in detail here.

When yarn 1 is passed through yarn tension sensing means 16, means 16 generates an electrical signal corresponding to the tension in the yarn, and the out-put signal from means 16 is applied to comparing means 18 wherein the input signal is compared with a pre-set electrical signal and an error compensation signal is generated in accordance with the difference between said signals. The output signal from comparing means 18 is selectively fed into speed changing means 19A or 19B via switch 91.

As shown in FIG. 11, when yarn 1 is wound on bobbin tube 9A mounted on winding spindle 7A, the output error compensation signal from comparing means 18 is applied to speed changing means 19A via contact 91A of switch 91. The speed changing means controls first motor 12A which drives winding spindle 7A in such a way that the error compensation signal will not be generated from comparing means 18, whereby the winding speed can be kept at a substantially constant speed.

If first motors 12A and 12B are induction motors, preferably speed changing means 19A and 19B are invertors which respectively control the frequency of the drive current of induction motors 12A and 12B in accordance with the error compensation signal from comparing means 18.

If first motors 12A and 12B are D.C. motors, speed changing means 19A and 19B are respectively D.C. motor controllers which control the field current of the D.C. motors in accordance with the error signal compensation from comparing means 18.

While winding spindle 7A rotates together with rotary disc 21A, pulse pickup 22A generates an electrical signal corresponding to the rotational speed of the winding spindle 7A. The output signal from pulse pickup 22A is applied via contact 93A of switch 93 to frequency multiplying and dividing unit 29. The output signal from the multiplying and dividing unit 29 is applied to comparing means 25 and to frequency/voltage convertor 32. In comparing means 25, the input signal from multiplying and dividing unit 29 is compared with another input signal from pickup 24 which input signal is generated corresponding to the rotational speed of the traverse element driving shaft 6.

The output signal from comparing means 25 is applied to adder 33, whereas the output signal from the frequency/voltage converter 32 is also applied to adder 33 where said two signals are combined. The output signal from adder 33 is applied to speed changing means 28. In accordance with the input signal from adder 33, speed changing means 28 controls the second motor in such a way that an output signal will not be generated by comparing means 25. The means for controlling the wind ratio according to the embodiment illustrated in FIGS. 10 to 12 is substantially the same as that of the embodiments illustrated in FIGS. 1 to 5, and therefore will not be explained in detail here.

When package 11 on bobbin tube 9A becomes a full package, bobbin-exchanging takes place as follows.

Firstly, controller 90 is actuated, which controller selectively controls speed changing means 19A and 19B in order to provisionally drive a first motor for a winding spindle having an empty bobbin tube. As illustrated in FIG. 11, controller 90 is connected to speed changing means 19B via contact 92B of switch 92, so that first motor 12B starts to rotate. After the time necessary to bring the drive of the winding spindle 7B to a predetermined speed, the revolving arm 34 is rotated about the axis 35, so that the full package on winding spindle 7A is exchanged for the empty bobbin 9B on winding spindle 7B, with their respective positions as illustrated in FIG. 12.

As soon as the completion of the bobbin-exchange occurs, contact 91A of switch 91 is opened, whereas contact 91B of switch 91 is closed. Thus, the first motor 12B is driven normally, but the other first motor 12A is stopped. Now, yarn 1 is wound on bobbin tube 9B at a constant wind ratio. Regarding the controller 90, after the bobbin-exchange, contact 92B is opened and contact 92A is closed, so that the speed changing is ready for the next bobbin-exchange.

Figure 13:
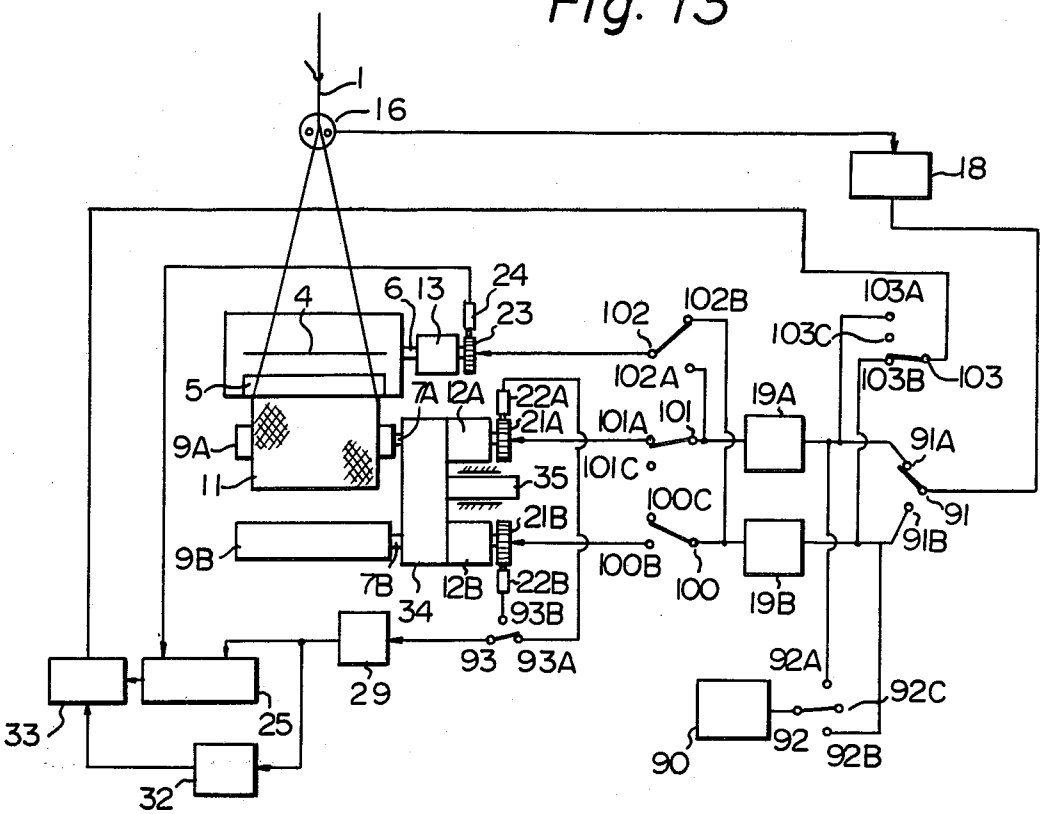
FIG. 13 is a schematic front view of another revolving type winder of the present invention.
Figure 14:
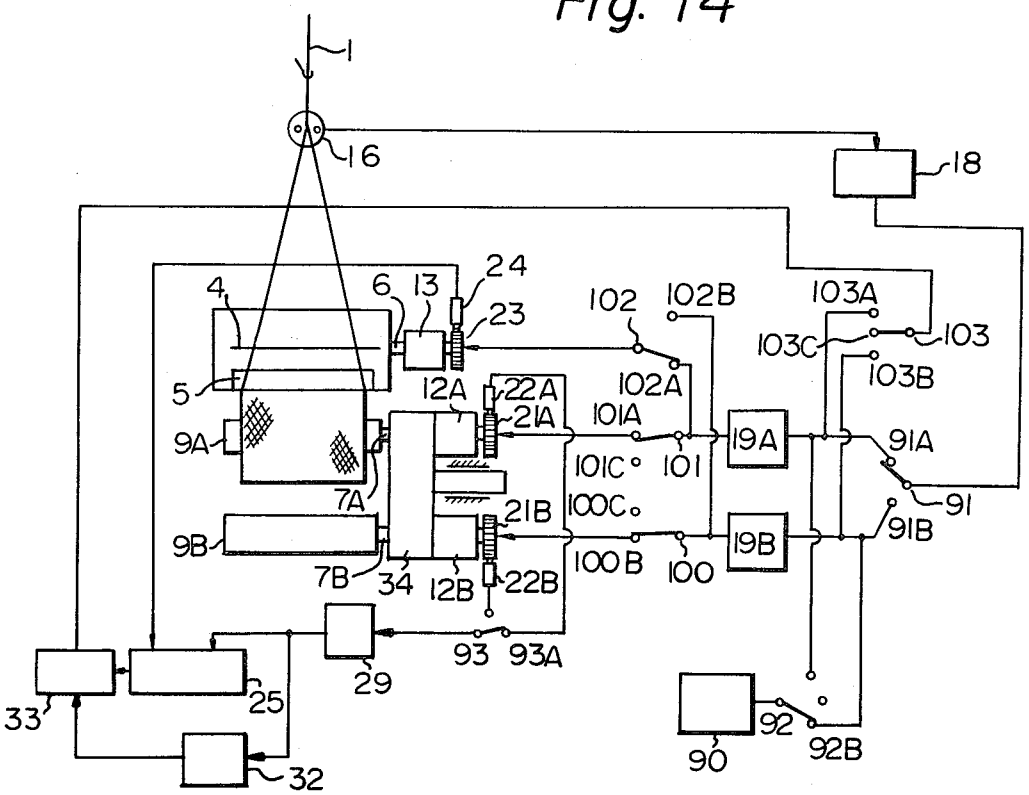
FIGS. 14 and 15 are schematic front views of the winder illustrated in FIG. 13, which respectively show different conditions of the winder.
Figure 15:
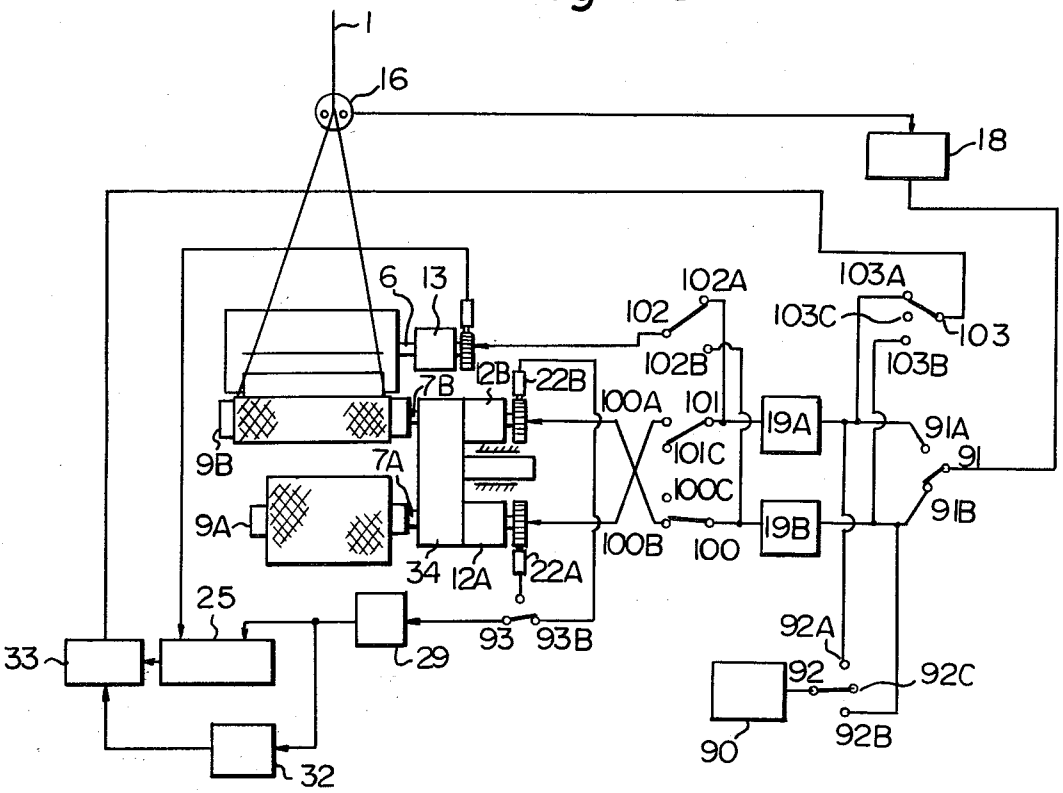

FIGS. 13 to 15 illustrate another embodiment of the present invention, which is also applied to a revolving-type winder.

This embodiment is very similar to the embodiment as illustrated in FIGS. 11 and 12, except for the following point. In this embodiment, a speed changing means is not provided exclusively for driving a traverse element driving shaft, but only two speed changing means 19A and 19B are provided.

Comparing means 18 is selectively connected to one of the speed changing means 19A or 19B via switch 91 by means of contacts 91A and 91B. The output signal from speed changing means 19A is selectively applied to first motor 12A and second motor 13 for the traverse means, via switch 101 or switch 102. The output signal from speed changing means 19B is selectively applied to first motor 12B and second motor 13 via switch 100 or switch 102. Controller 90 is selectively connected with speed changing means 19A or 19B via switch 92. Further, an output signal from adder 33 is selectively fed to speed changing means 19A or 19B via switch 103.

As illustrated in FIG. 13, when a yarn is wound on bobbin tube 9A mounted on winding spindle 7A, an electrical signal produced by yarn tension sensing means 16 is fed to comparing means 18, wherein said signal is compared with a predetermined signal and an error compensation signal is generated in accordance with the difference between the input signal from the sensing means and the predetermined signal. The output signal from comparing means 18 is fed to speed changing means 19A via contact 91A of switch 91 and an output signal from speed changing means 19A is fed to first motor 12A via contact 101A of switch 101. Consequently the, first motor 12A is driven in such the manner that a tension in the yarn to be wound is kept substantially constant. On the other hand, first motor 12B is stopped.

While winding spindle 7A rotates together with rotary disc 21A, pulse pickup 22A generates an electrical signal corresponding to the rotational speed of winding spindle 7A. The output signal from pulse pickup 22A is fed via contact 93A of switch 93 to frequency multiplying and dividing unit 29. The output signal from unit 29 is simultaneously fed to comparing means 25 and to frequency/voltage converter 32, and the output signal from comparing means 25 and the output signal from F/V converter 32 are fed to adder 33 in the same manner as explained with regard to FIG. 5. The output signal from adder 33 is fed to speed changing means 19B via contact 103B of switch 103. At this time, speed changing means 19B is connected to second motor 13 via contact 102B of switch 102. Consequently, the rotational speed of traverse element driving shaft 6 is driven in such a manner that an output signal from comparing means 25 is not generated, whereby the wind ratio is kept constant. Regarding controller 90, switch 92 is disposed at position 92C free from contacts 92A and 92B.

When package 11 on bobbin tube 9A becomes full, bobbin-exchanging takes place as follows:

As illustrated in FIG. 14, in order to accelerate winding spindle 7B, which has been stopped, up to a predetermined rotational speed prior to the normal winding operation, contact 102B of switch 102 is opened but contact 102A is closed, and switch 103 is disposed at position 103C free from contacts 103A and 103B. As a result, the speed changing means 19B is ready for accelerating winding spindle 7B with an empty bobbin tube, and second motor 13 is controlled by speed changing means 19A which also controls first motor 12A at this time so that the wind ratio may be changed under these conditions. Preferably, in order to prevent the wind ratio from changing at this time there is provided a regulating means, such as a timing belt or a pulley or the like, in the driving system of the traverse means.

Then, contact 92B of switch 92 is selected and contact 100B of switch 100 is selected, so that the speed changing means 19B is connected with controller 90 and with first motor 12B. As a result first motor 12B is driven up to a predetermined rotational speed. After the rotational speed of winding spindle 7B has reached a given speed, revolving arm 34 is revolved and the two winding spindles 7A and 7B are exchanged.

FIG. 15 illustrates a state of the winder after the bobbin exchange has taken place and the normal winding operation is carried out on winding spindle 7B. As shown in FIG. 15, contact 91B, contact 100B, contact 102A and contact 103A are respectively selected. Therefore, first motor 12B is controlled by speed changing means 19B, whereas second motor 13 is controlled by speed changing means 19A. Speed changing means 19B is controlled by the output signal from comparing means 18 and the other speed changing means 19A is controlled by the output signal from adder 33, so that a yarn is wound on winding spindle 7B at a constant wind ratio.

Figure 16:
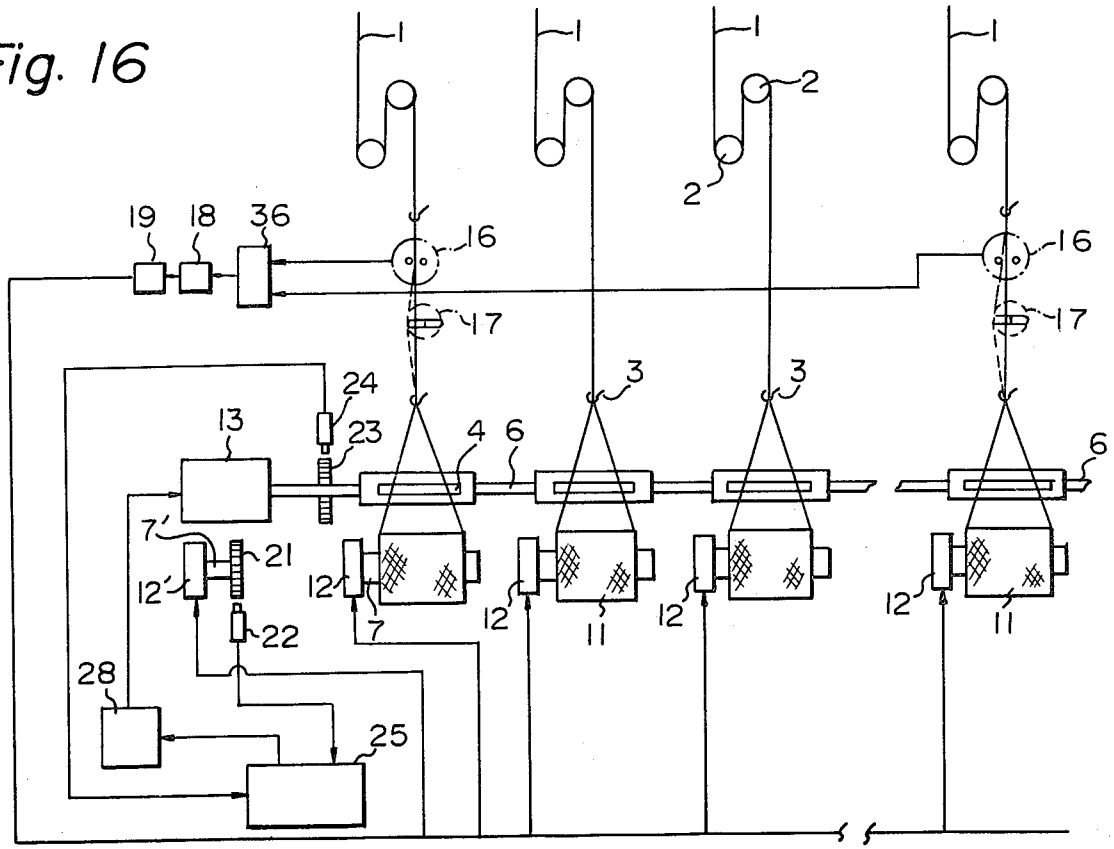
FIG. 16 is a schematic front view of an embodiment of a yarn winding apparatus of the present invention, which apparatus has a plurality of winding devices.

FIG. 16 illustrates an embodiment of the present invention, wherein the yarn winding apparatus comprises a plurality of winding devices.

According to this embodiment, a plurality of winding spindles 7 are provided and each winding spindle has a first motor 12. A plurality of traverse elements 4 are disposed corresponding to winding spindles 7 and all the traverse elements are driven by a common driving shaft 6. The common driving shaft 6 is driven by a second motor 13. In order to detect the rotational speed of a winding spindle, motor 12′ which is the same type as the first motor 12 is provided and a shaft 7′ having rotary disc 21 is driven by motor 12′. Pulse pickup 22 is disposed against rotary disc 21. In this embodiment, synchronous motors are preferably used as motors 12 and 12′.

The embodiment illustrated in FIG. 16 is similar to the embodiments explained regarding FIGS. 1 to 9, except for the following points.

That is, yarn tension sensing means 16 are provided for some of winding devices, for example if there are 200 winding devices, 10 yarn tension sensing means are provided. The output signals from each yarn tension sensing means 16 are fed to means for producing a tension representing signal 36. One embodiment of the tension representing signal producing means 36 is means for averaging output signals fed from a plurality of yarn tension sensing means 16 and for applying averaged output signal therefrom to comparing means 18.

Another embodiment of the tension representing signal producing means 36 is means for selectively applying one of the output signals from a plurality of yarn tension sensing means 16 to comparing means 18.

The output signal from the tension representing signal producing means 36 is fed to the comparing means in which the signal is compared with a predetermined signal. The output error compensation signal from the comparing means 18 is fed to a speed changing means. The output signal from speed changing means 19 is simultaneously fed to motor 12′ and all of the winding spindles of the first motor 12. Consequently, the rotational speeds of all the winding spindles are simultaneously controlled.

In the embodiment of FIG. 16, the manner of controlling the wind ratio is similar to that in the embodiments explained previously in this specification.

Figure 17:
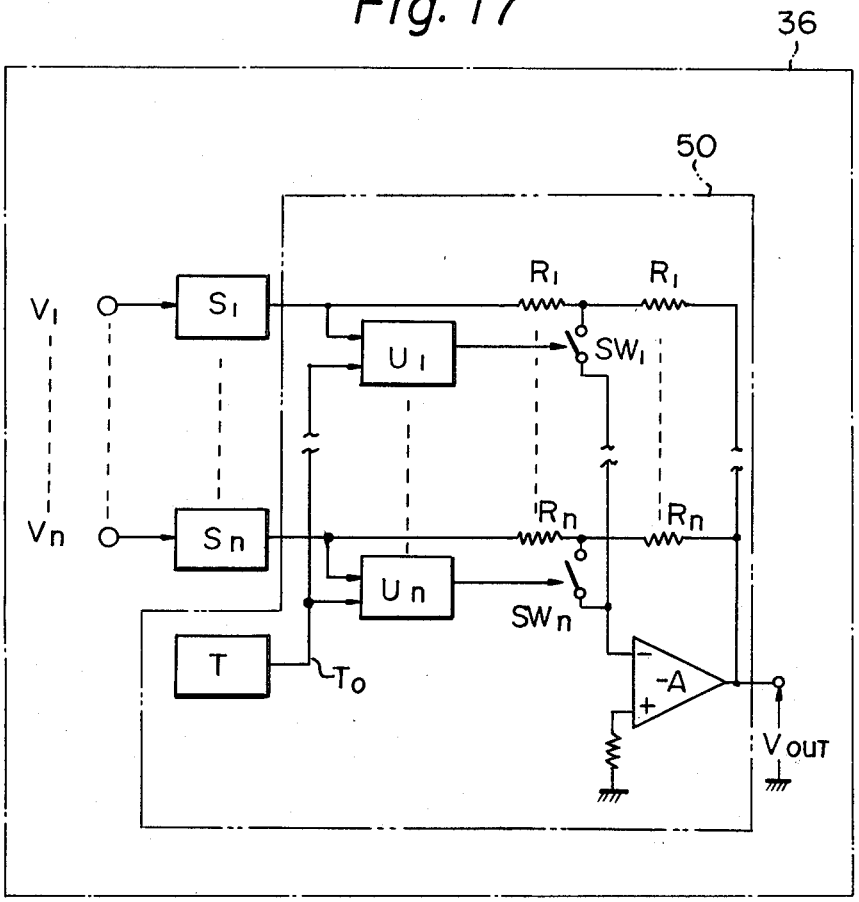
FIG. 17 is a block diagram of an embodiment of means for producing a tension representing signal illustrated in FIG. 16.

FIG. 17 illustrates an embodiment of means 36 for producing a tension representing signal. In this embodiment, means 36 comprises rectifying and smoothing circuits $S_1$ to $S_n$ which convert alternating signals from tension sensing means 16 such as disclosed in U.S. Pat. No. 3,931,938 and U.K. Patent Publication No. 2,015,589 A, into D.C. voltage signals, and an averaging circuit 50 for averaging the D.C. voltage signals from the rectifying and smoothing circuits $S_1$ to $S_n$ and for producing an averaged voltage as a tension representing signal. The averaging circuit 50 includes an adder circuit constructed so that its amplifying factor can be changed in accordance with the number of absent D.C. voltage signals. In order to detect this absence, the average circuit 50 further includes comparators $U_1$ to $U_n$ which compare the D.C. voltage signals with a predetermined reference voltage from a reference signal circuit T, respectively. If the absence of a D.C. voltage signal, which absence may be caused by a yarn breakage, is detected, corresponding switching means $SW_1$ to $SW_n$ in the averaging circuit 50 are turned off to effect an increase of the amplifying factor of the adder circuit, whereby circuit 50 can always produce average D.C. voltage signals from the rectifying and smoothing circuits in accordance with the number of existing D.C. voltage signals. Consequently, irrespective of yarn breakage, means 36 illustrated in FIG. 17 can produce an appropriate averaged signal as a tension representing signal.

Figure 18:
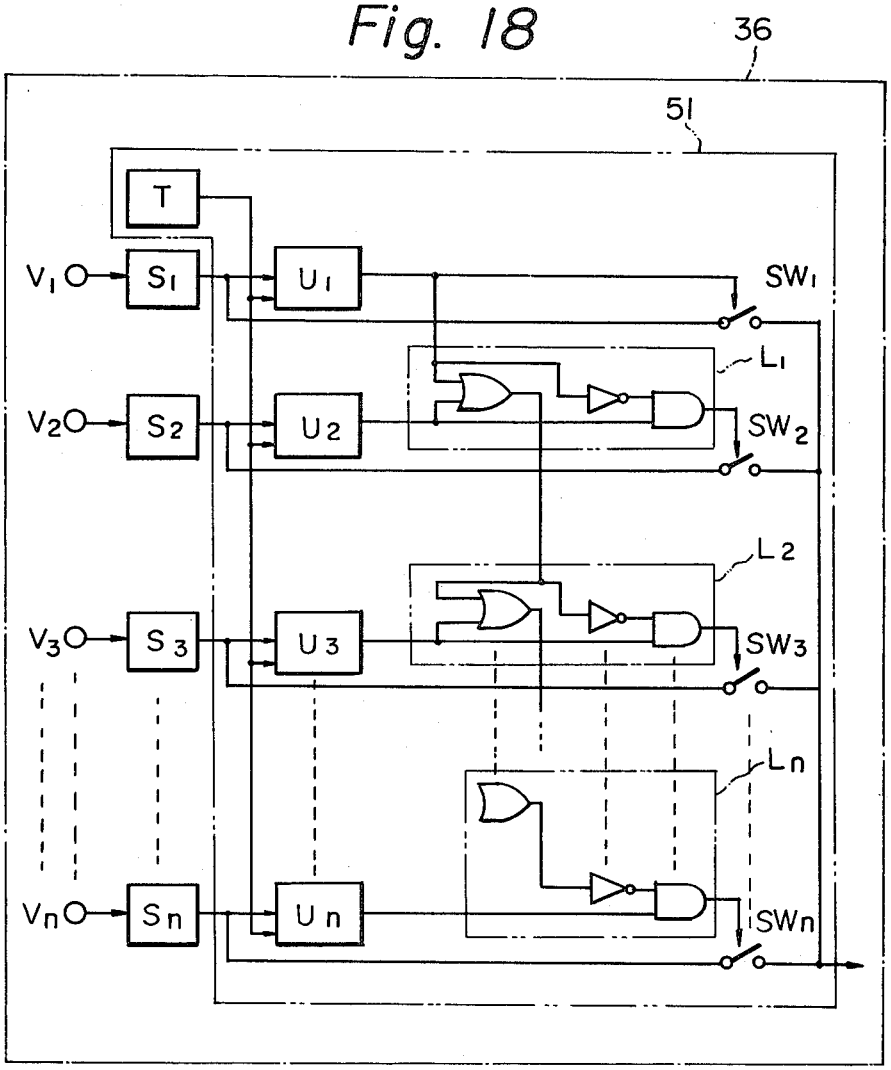
FIG. 18 is a block diagram of another embodiment of means for producing a tension representing signal illustrated in FIG. 16.

FIG. 18 illustrates another embodiment of means 36 for producing a tension representing signal. In this embodiment, means 36 comprises rectifying and smoothing circuits $S_1$ to $S_n$ which convert alternating signals from tension sensing means 16 into D.C. voltage signals, and selection circuit 51 is used for selecting only one of the D.C. voltage signals from the rectifying and smoothing circuits $S_1$ to $S_n$ as tension representing signal. Selection circuit 51 includes comparators $U_1$ to $U_n$ for comparing the D.C. voltage signals with a predetermined reference voltage from reference signal circuit T, respectively, so as to detect the absence of D.C. voltage signals. Selection circuit 51 further includes switching means $SW_1$ to $SW_n$ and logical circuits $L_1$ to $L_n$ for turning on only one of the switching means $SW_1$ to $SW_n$ in response to the detected result from the comparators $U_1$ to $U_n$. If comparator $U_1$ does not detect the absence of the D.C. voltage signal, only switching means $SW_1$ turns on and the D.C. voltage signal from rectifying and smoothing circuit $S_1$ is output as a tension representing signal. Contrary to this, if comparator $U_1$ detects the absence of the D.C. voltage signal from rectifying and smoothing circuit $S_1$, switching means $SW_1$ turns off and only switching means $SW_2$ turns on to pass the D.C. voltage signal from rectifying and smoothing circuit $S_2$ as a tension representing signal.

Figure 19:
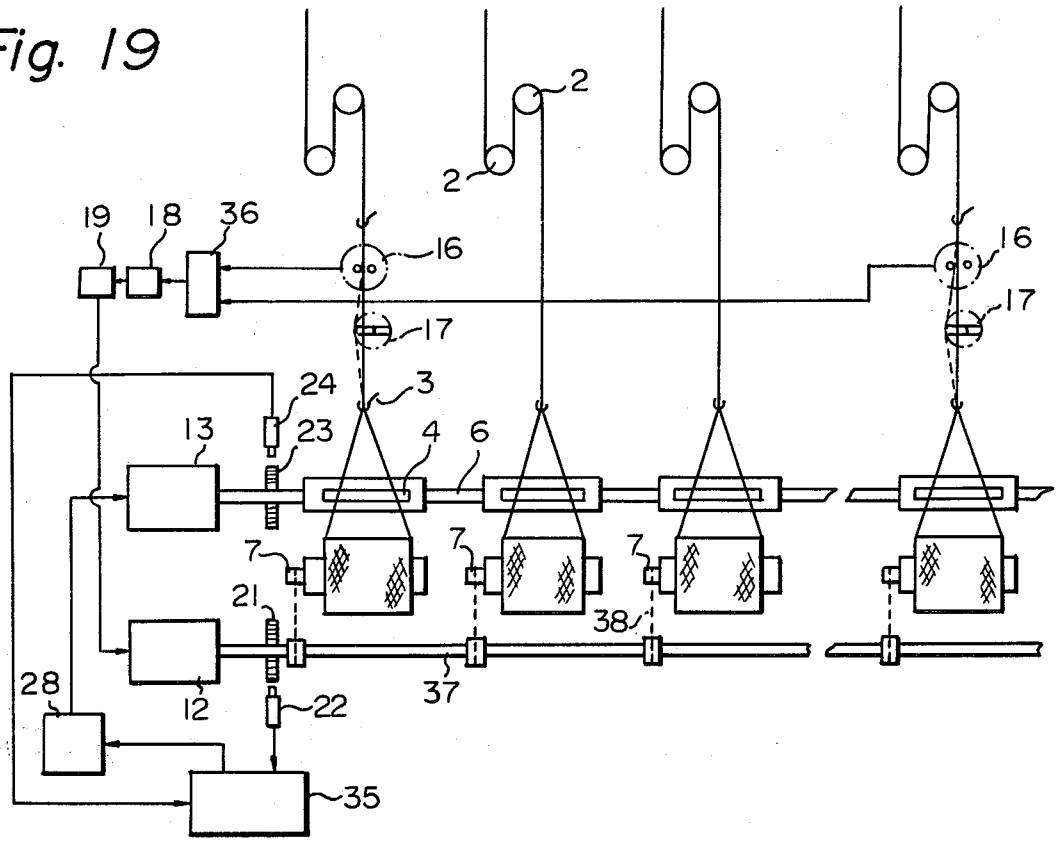
FIG. 19 is a schematic front view of another embodiment of a yarn winding apparatus of the present invention, which apparatus has a plurality of winding devices.

FIG. 19 illustrates another embodiment of the present invention. This embodiment is very similar to the embodiment of FIG. 16, except for the following points.

That is, a plurality of winding spindles 7 are simultaneously driven by a common winding spindle driving shaft 37 via gear means 38. The common winding spindle driving shaft is driven by first motor 12 and is provided with rotary disc 21. Pulse pickup 22 is disposed against rotary disc 21.

According to this embodiment of FIG. 19, the wind ratio is controlled in a manner similar to the manner described for embodiments previously discussed.

Figure 20:
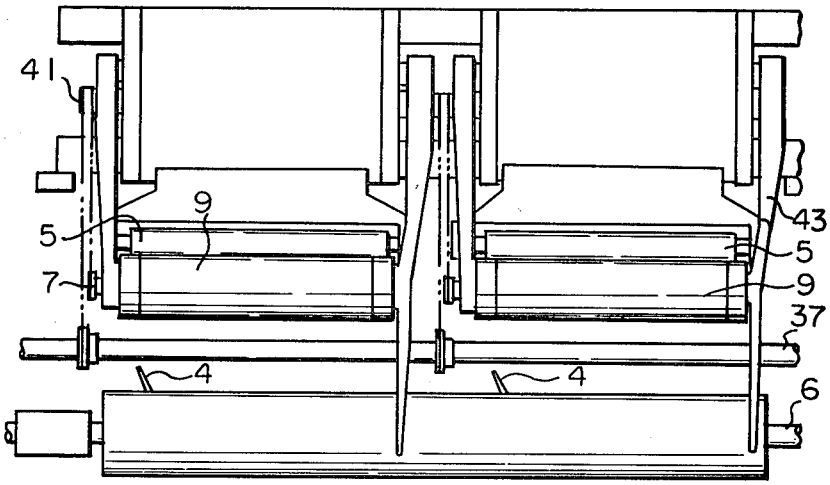
FIG. 20 is a plan view of a winding device illustrated in FIG. 19.
Figure 21:
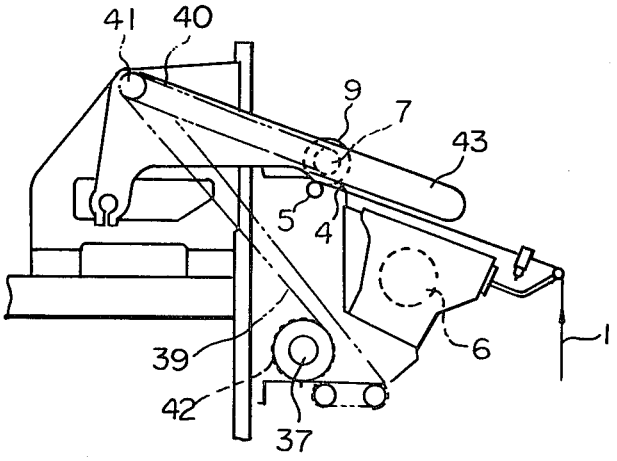
FIG. 21 is a side view of a winding device illustrated in FIG. 20.

FIGS. 20 and 21 illustrate an embodiment of a winding device which is similar to that of FIG. 19.

FIG. 20 is a schematic plan view of the winding device and FIG. 21 is a schematic side view thereof. According to this winding device supplied yarn 1 is passed through a yarn guide and through traverse element 4 which imparts the traverse motion to the yarn, and then is wound on bobbin tube 9 supported on winding spindle 7. Bobbin tube 9 or the package is contacted with touch roller 5 under appropriate contacting pressure. Traverse element 4 is driven by means of traverse element driving shaft 6. On the other hand, winding spindle 7 is driven via toothed timing belts 39 and 40, pulley 41 and timing pulley 42. Timing pulley 42 is mounted on a common winding spindle driving shaft 37. Pulley 41 is supported on an axis, about which axis cradle 43 is swingable.

A yarn winding apparatus as illustrated in FIGS. 16, 19, 20 and 21 may be advantageously utilized for simultaneously winding a plurality of yarns as a draw winder or a rewinder. In such a winding apparatus, tension in each yarn is substantially the same. Even if the tension in a yarn is different from that of others, the yarn tension controls itself automatically during winding and makes the tension in all the yarns uniform. The reason this automatically takes place is as follows. When the tension in any one yarn is higher than that of other yarns, this yarn with the higher tension tends to be wound more tightly on a package than others, whereby the rate of increase of the diameter of that tightly wound package is less than that of the others. As a result the winding speed, which is correlated to the diameter of the package of the yarn in question will be decreased, and as the tension in the yarn will be lowered. On the other hand, when the tension in any one yarn is less than that of others, that particular yarn will be wound loosely and the diameter of that package of yarn will increase more quickly than that of others, so that the winding speed is increased and the tension in that particular yarn will also be increased and will become the same as that of the other yarns.

What is claimed is:

1. A yarn winding apparatus comprising:

(a) a winding device for winding a yarn to form a yarn package on a bobbin, which includes a pair of winding spindles for mounting a bobbin and capable of being alternately positioned in a winding position of the winding device, a traverse element for imparting a traverse motion to the yarn, and a driving shaft for driving the traverse element;

(b) a pair of first motors, each driving a corresponding winding spindle which is in the winding position;

(c) a second motor for driving the traverse element driving shaft;

(d) a pair of spindle speed detecting means, each detecting the speed of rotation of a corresponding winding spindle which is in the winding position, and for generating a first electrical signal corresponding to the detected rotational speed thereof;

(e) means for detecting the speed of rotation of the traverse element driving shaft and for generating a second electrical signal corresponding to the detected rotational speed thereof; and (f) a pair of means for controlling rotational speed of said motors, a first speed controlling means including means for controlling one of the pair of first motors which is positioned in the winding position so as to keep a yarn winding speed substantially constant from the beginning to the completion of the winding operation of the yarn package; and a second speed controlling means including means for controlling the second motor so as to substantially keep the ratio of the rotational speed of the winding spindle to the rotational speed of the traverse element driving shaft at a predetermined value or values from the beginning to the completion of the winding operation of the yarn package in response to the first electrical signal and the second electrical signal.

2. Apparatus according to claim 1, wherein said means for controlling the second motor controls said second motor so a to change the ratio of the rotational speed of the winding spindle to the rotational speed of the traverse element driving shaft to predetermined values step by step during the winding, each of the ratios being kept substantially constant for a certain time duration.

3. Apparatus according to claim 1, wherein said means for controlling the second motor comprises: a means for comparing the first electrical signal with the second electrical signal and producing a third electrical signal corresponding to the difference between said first and second electrical signals; and a speed changing means actuated by said third electrical signal, for controlling the rotational speed of the second motor.

4. Apparatus according to claim 3, wherein said means for controlling the second motor further comprises: a frequency multiplying and dividing unit, which unit multiplies and divides the first electrical signal; and a frequency/voltage converter, output signals from said frequency multiplying and dividing unit being simultaneously applied to the comparing means and said frequency/voltage converter, and output signals from the frequency/voltage converter being applied to the speed changing means.

5. Apparatus according to claim 4, wherein the frequency multiplying and dividing means is capable of being actuated in accordance with a predetermined control program.

6. Apparatus according to claim 3, wherein the speed changing means is an invertor.

7. Apparatus according to claim 1, wherein means for controlling the first motor comprises: a yarn tension sensing means disposed upstream of the winding device, for generating an electrical signal indicative of the tension in the yarn to be wound; a means for comparing said signal from said yarn tension sensing means with a predetermined electrical signal and for generating an error compensation signal in accordance with the difference between said signal from said sensing means and said predetermined signal; and a speed changing means for controlling the rotational speed of the first motor in accordance with said error compensation signal.

* * * * *

UNITED STATES PATENT AND TRADEMARK OFFICE

CERTIFICATE OF CORRECTION

PATENT NO. : 4,394,986

DATED : 7/26/83

INVENTOR(S) : Katsumi Hasegawa; Takahiro Kawabata and Shintaro Kuge

It is certified that error appears in the above-identified patent and that said Letters Patent is hereby corrected as shown below:

Column 3, line 55, after "with" insert --the--.

Column 7, line 14, delete "elastivity" and insert --elasticity--.

Column 7, line 59 after "160" insert --mm--.

Column 8, line 44, delete "are".

Column 8, line 45, after "are" insert --additionally--.

Column 13, line 18, delete "the" (first occurrence).

Column 13, line 19, delete "a" and insert --the--.

Column 13, line 18, delete "the" second occurrence and insert --a--.

Signed and Sealed this

First Day of May 1984

[SEAL]

*Attest:*

GERALD J. MOSSINGHOFF

*Attesting Officer*

*Commissioner of Patents and Trademarks*